US008813519B2

(12) United States Patent
Rydlewicz

(10) Patent No.: US 8,813,519 B2
(45) **Date of Patent: *Aug. 26, 2014**

(54) MODIFIED PRINCESS CUT DIAMOND HAVING HEARTS AND ARROWS PATTERN AND METHOD

(75) Inventor: Roni Rydlewicz, Antwerp (BE)

(73) Assignee: Worldwide Diamonds Trademarks Ltd., Vancouver, BC (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/205,457

(22) Filed: Aug. 8, 2011

(65) Prior Publication Data

US 2013/0019636 A1 Jan. 24, 2013

Related U.S. Application Data

(63) Continuation-in-part of application No. 11/286,218, filed on Nov. 23, 2005, now Pat. No. 7,992,410.

(51) Int. Cl.
*A44C 17/00* (2006.01)

(52) U.S. Cl.
CPC ..... *A44C 17/001* (2013.01)
USPC ..... 63/32; D11/89; D11/90

(58) Field of Classification Search
CPC ..... A44C 17/001; B24B 9/16; B24B 9/163; B28D 5/00; B28D 5/02
USPC ..... 63/32; D11/89, 90
See application file for complete search history.

(56) References Cited

U.S. PATENT DOCUMENTS

| | | | | |
|---|---|---|---|---|
| D439,542 | S * | 3/2001 | Turner et al. | D11/90 |
| D522,908 | S * | 6/2006 | Horowitz et al. | D11/90 |
| 2003/0221452 | A1* | 12/2003 | Morbidoni | 63/26 |

* cited by examiner

*Primary Examiner* — Jack W Lavinder
(74) *Attorney, Agent, or Firm* — Baker Hostetler LLP

(57) ABSTRACT

A modified princess cut diamond and method of forming a modified princess cut diamond into a symmetrical shape possessing a hearts and arrows pattern characteristic of the true hearts and arrows pattern in a round cut diamond. The modified princess cut diamond includes: a tablet facet, 4 main crown facets, 8 crown halves, 8 crown star facets, 4 subsidiary crown facets, 8 subsidiary crown halves, 8 main pavilion facets, 4, subsidiary pavilion facets, 16 pavilion halves and a girdle with each main crown facet having a pair of crown star facets symmetrically disposed on one side thereof adjacent to the tablet facet and a pair of crown halves symmetrically disposed on the opposite sides thereof with each pair of crown star facets having the side thereof adjoining the table facet meeting at a point equal to essentially half the longer distance of the main crown facet measured horizontally and with all crown star facets and crown halves adjacent each main crown having identical polished angles with a maximum tolerance of 0.30.

7 Claims, 8 Drawing Sheets

Hearts

Arrows

True Hearts & Arrows Pattern

Imperfect Hearts & Arrows Pattern

Hearts

Arrows

MODIFIED PRINCESS CUT DIAMOND HAVING HEARTS AND ARROWS PATTERN AND METHOD

FIELD OF THE INVENTION

The present invention is an improvement to the modified princess cut diamond application Ser. No. 11/286,218 filed on Nov. 23, 2005 for forming a princess cut diamond possessing a hearts and arrows pattern characteristic substantially equivalent to the hearts and arrows pattern in an ideal round cut diamond.

BACKGROUND OF THE INVENTION

The beauty of a properly cut diamond gemstone derives from the manner in which the cut facets of the diamond reflect and refract light. Diamonds may be cut into many different geometrical patterns which are known in the art as the round cut, oval cut, pear cut, marquis cut, princess cut, emerald cut, etc. The most popular diamond cut is the standard round cut because of its brilliance and optical light handling properties. Although caret weight and clarity are factors which will affect the value of the diamond independent of cut geometry, the most significant value is attributed to its optical properties and color.

A gemologist will refer to the optical properties of a diamond cut using terms of art such as brilliance, scintillation and symmetry. Brilliance and scintillation correspond to the intensity of returned light, and scintillation and symmetry relate to the cut parameters of the diamond and the degree to which the cut facets are aligned. To provide the highest possible level of scintillation with minimal loss in brilliance when analyzed with a brilliance scope, a diamond must possess cut parameters which are as close to perfect as possible. A brilliance scope is currently used by most grading institutes, such as the Gemological Institute of America (GIA) and the American Gemological Society (AGS), for analyzing the loss of brilliance on an ideal cut round diamond. Both of these institutes, among others, specialize in grading the most valuable diamonds and the best cut grades available.

The most valuable round cut diamond with the best cut grade possesses what is known to those skilled in the art as a "true hearts and arrows pattern'. A round cut diamond will invariably display a "hearts and arrows pattern", but only when the pattern is symmetrically cut will it display a "true hearts and arrows pattern" as known to those skilled in the art. Heretofore, a "true hearts and arrows pattern" could be achieved only in the round cut diamond. The symmetry requirement necessary for the hearts and arrows pattern to be "true" requires the cut diamond, once polished, to possess exacting requirements upon examination by an experienced gemologist using a 100× microscope so that the facets will be perfectly aligned and meet each other at a point. Until the present invention a diamond could not be cut into the princess pattern and provide the true hearts and arrows characteristic of the ideal round diamond.

SUMMARY OF THE INVENTION

The princess cut diamond of the present invention has a symmetrical diamond shape possessing a hearts and arrows pattern characteristic of the true hearts and arrows pattern in a round cut diamond and includes: a table facet, 4 main crown facets, 8 crown halves, 8 crown star facets, 4 subsidiary crown facets, 8 subsidiary crown halves, 8 main pavilion facets, 4, subsidiary pavilion facets, 16 pavilion halves and a girdle with each main crown facet having a pair of crown star facets symmetrically disposed on one side thereof adjacent to the table side and a pair of crown halves symmetrically disposed on the opposite side thereof with each pair of crown star facets meeting one another at a point equal to half the distance of the adjoining main crown facet and with all crown star facets and crown halves adjacent each main crown having identical polished angles with a maximum tolerance of 0.30. The modified princess cut diamond in accordance with the present invention does not include the subsidiary cut-corner pavilion facets a2 of the parent application. As indicated in the parent application, subsidiary cut-corner pavilion facets are not required to obtain the hearts and arrows pattern nor is it essential for the girdle thickness across the diamond to be the same.

The present invention is also directed to a method for polishing a diamond into a princess pattern consisting of: a tablet facet, 4 main crown facets, 8 crown halves, 8 crown star facets, 4 subsidiary crown facets, 8 subsidiary crown halves, 8 main pavilion facets, 16 pavilion halves and a girdle wherein the princess cut possesses a hearts and arrows pattern characteristic of the true hearts and arrows pattern in a round cut diamond, said method comprising the steps of: polishing the subsidiary crown facets to be smaller in length than the length of the crown halves, polishing the subsidiary crown facets to lie at an angle of 45 degrees relative to the adjacent crown halve facets such that the main crown halves are approximately of equal size when measured from the table side of the diamond; and with the main crown and main pavilion facets having the following cut angles:

main pavilion angles 40.60°-41°
main crown angles 34.0°-35.2°;
subsidiary pavilion angles 64°-67°; and
subsidiary crown angles 33.5°-34.5°.

To develop perfect symmetry it is preferred that the following additional parameters be satisfied: (1) the angles of the pavilion halves are 1.2° larger than the main pavilion angles; (2) the angles of the crown halves should be 3.8° larger than the main crown angles and (3) the crown star angles should be 4°-5° flatter than the main crown angles.

It is also significant to the method of the present invention that all facets be cut with a small angle tolerance such that the angle difference between all pavilion angles are smaller than 0.30 and the angle tolerance between the four main crown facets are smaller than 0.40 and the angle tolerance between the four subsidiary crown facets are smaller than 0.30.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

Figure 1B:
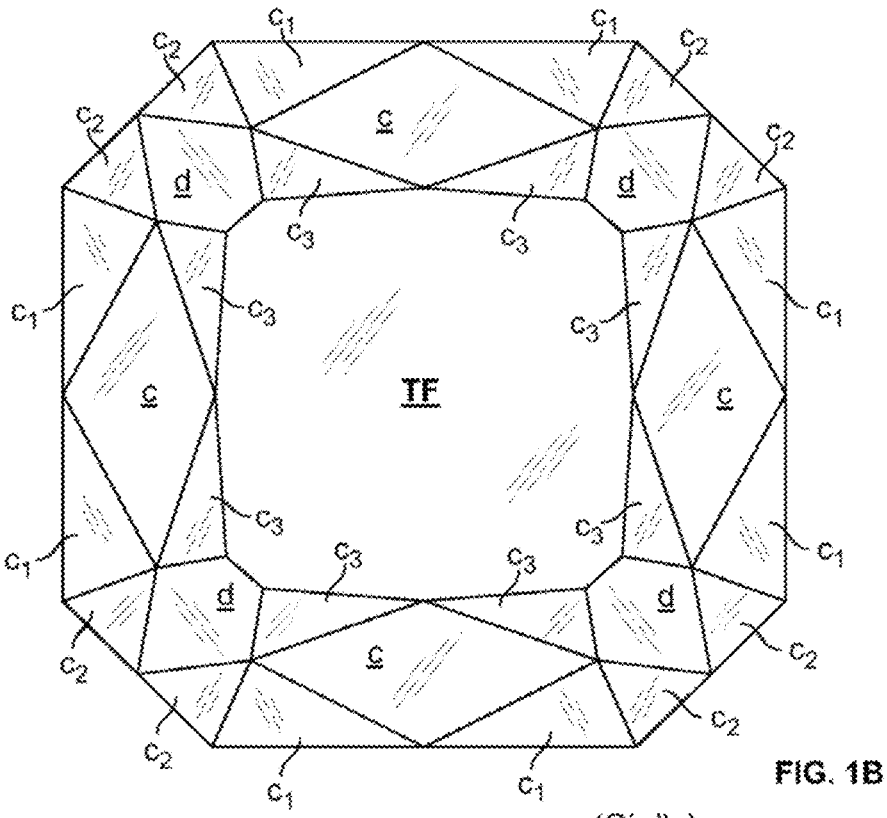
FIG. 1B is a top view of the princess cut diamond of FIG. 1A.
Figure 1A:
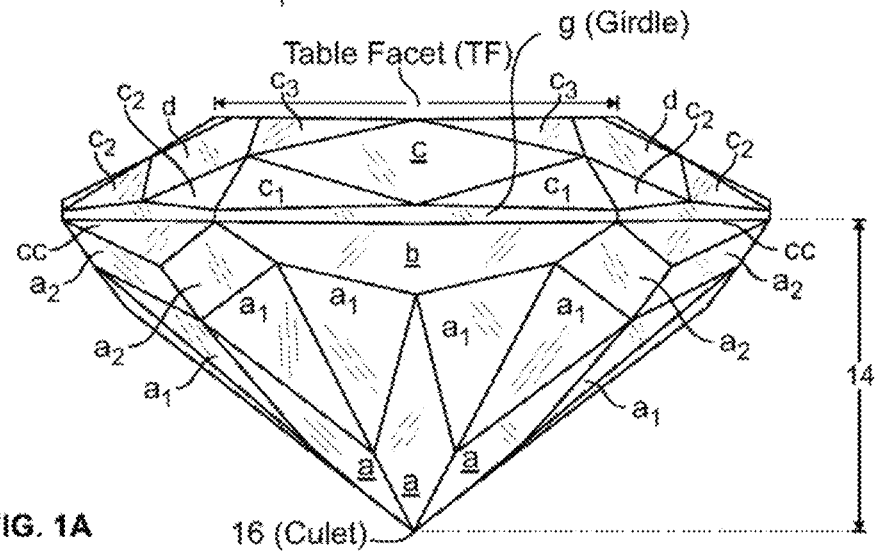
FIG. 1A is a front view of the princess cut diamond of the present invention.
Figure 1C:
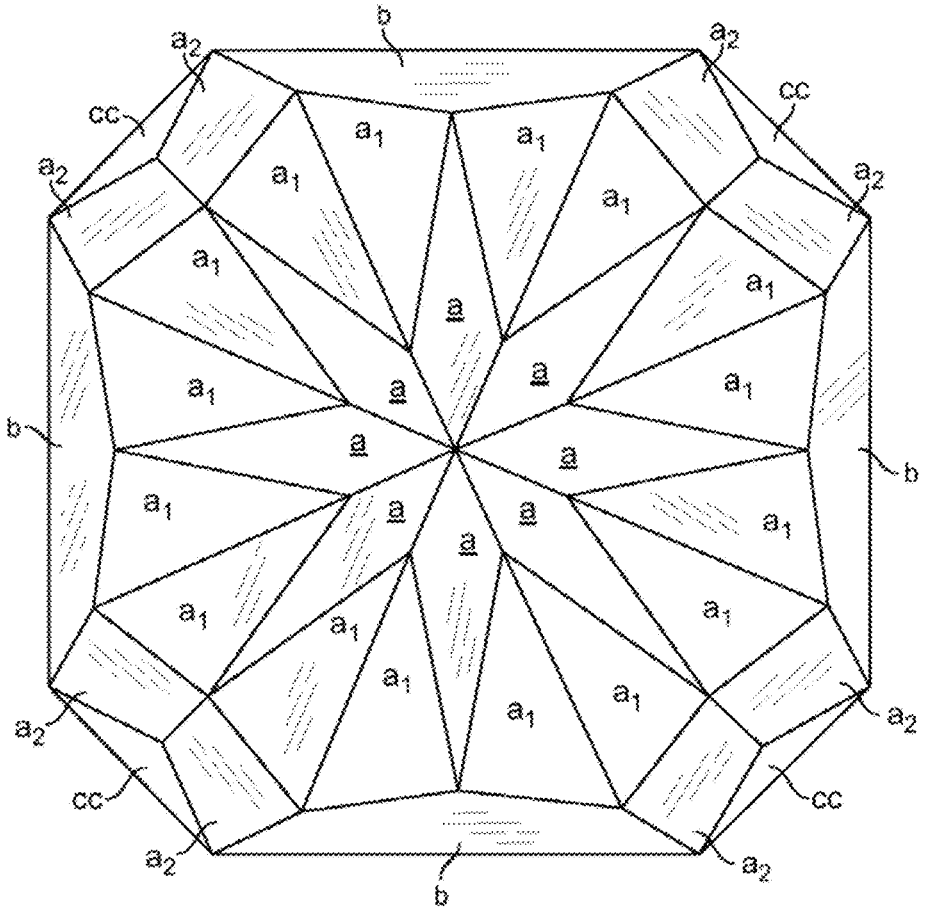
FIG. 1C is a bottom view of the princess cut diamond of FIG. 1A.
Figure 5B:
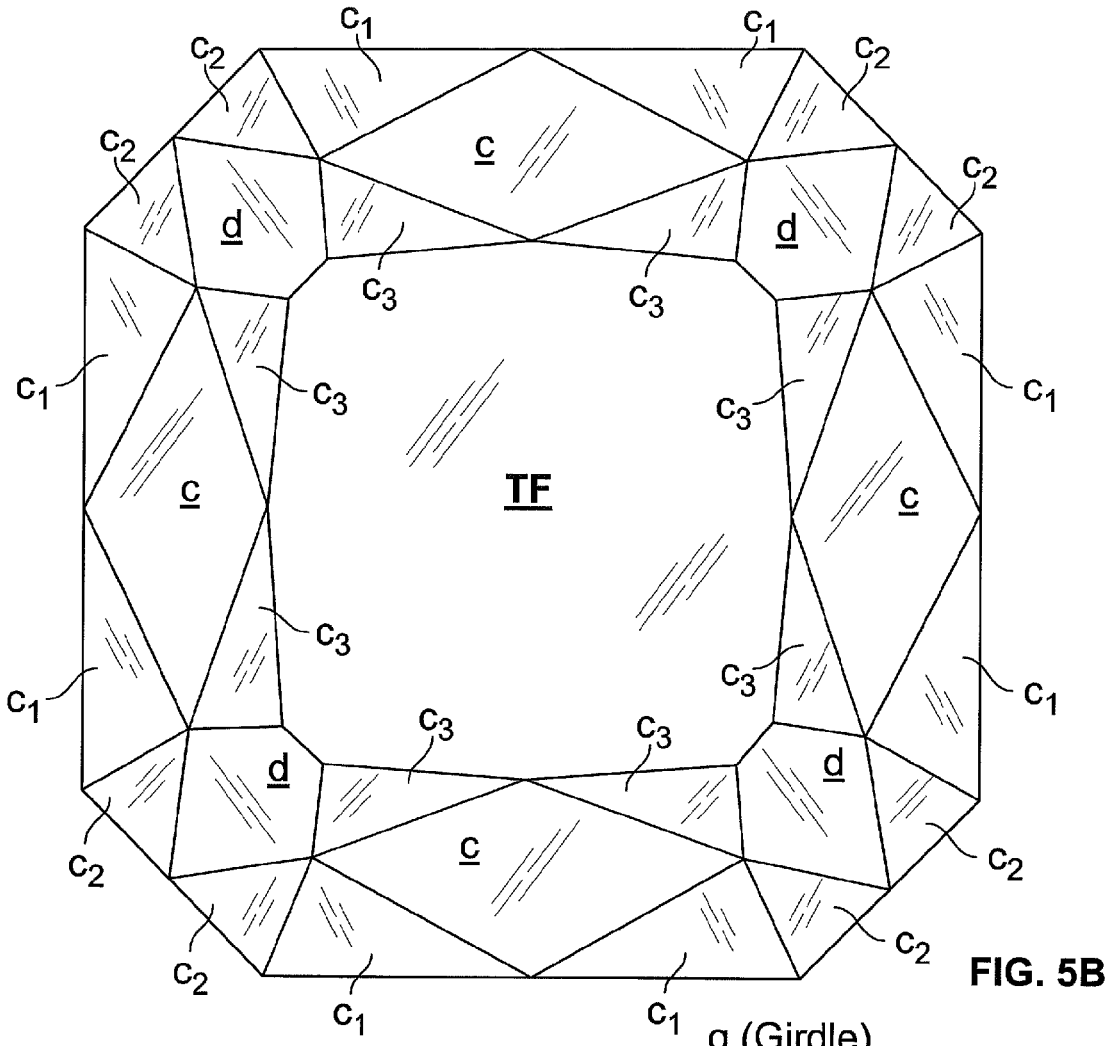
FIG. 5B is a top view of the princess cut diamond of FIG. 5A.
Figure 5A:
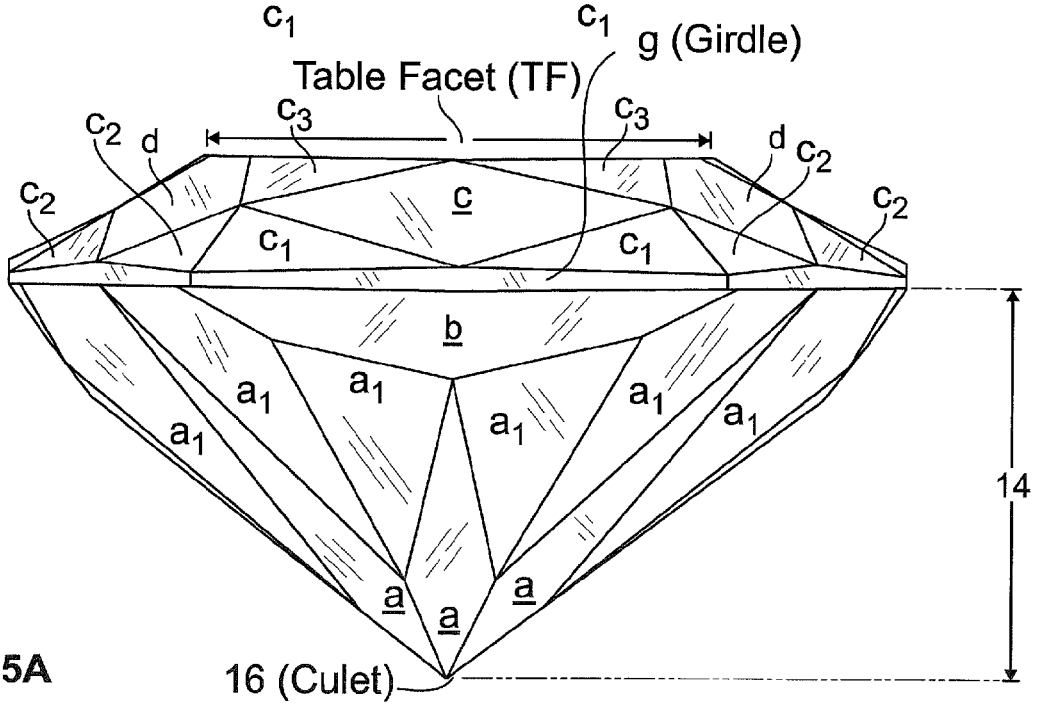
FIG. 5A is a front view of an alternate embodiment of the princess cut diamond of the present invention.
Figure 5C:
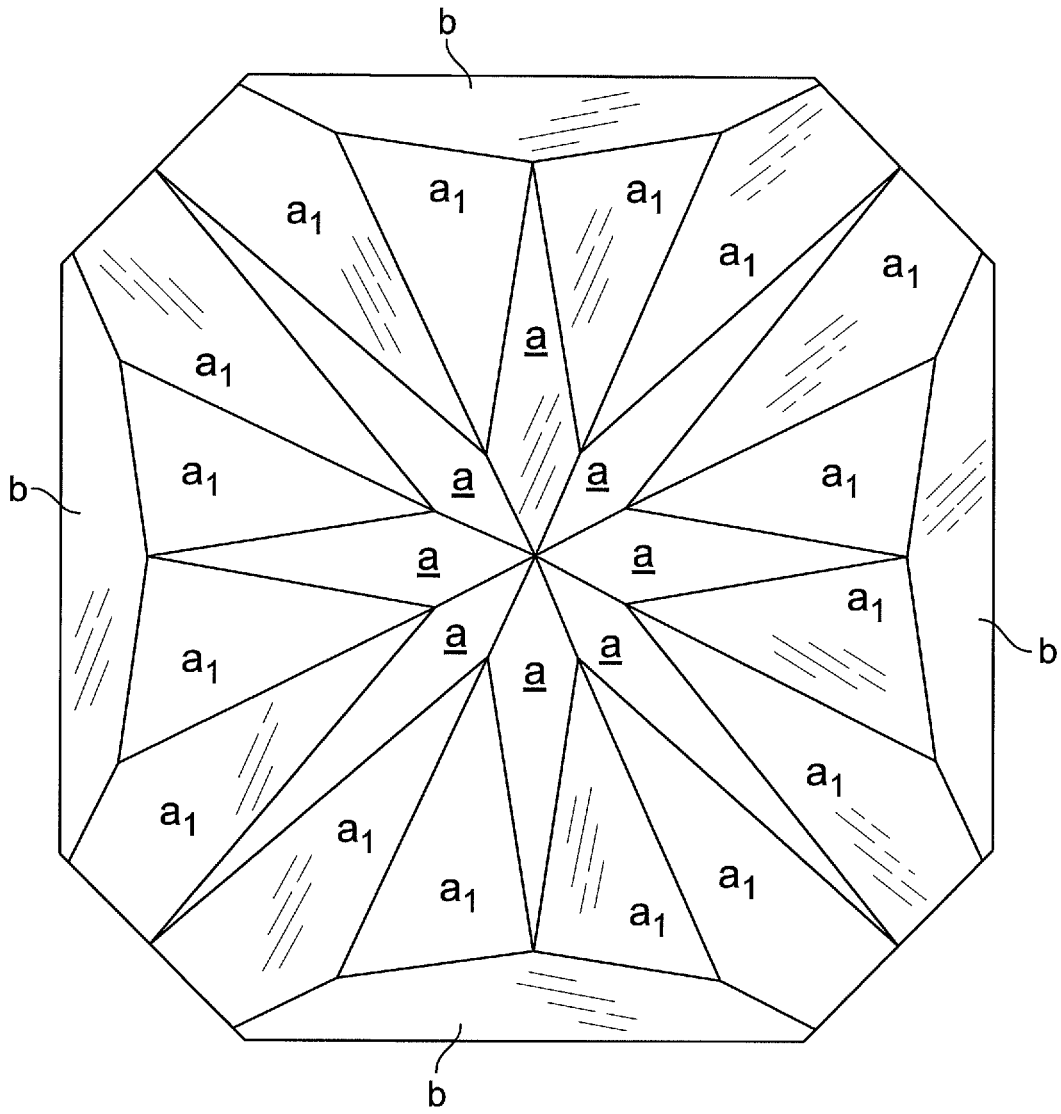
FIG. 5C is a bottom view of the princess cut diamond of FIG. 5A.

A diamond is a crystal which functions as a prism for dispersing light by means of reflection and refraction. When properly cut, a diamond possesses brilliancy characteristics highly attractive to the human eye. The princess cut diamond 10 of the present invention is shown in FIGS. 1A, 1B and 1C respectively and includes a crown portion 12 representing the top of the diamond, a pavilion portion 14 located below the crown portion and a girdle (g) which separates the crown portion 12 from the pavilion portion 14. FIGS. 5A, 5B and 5C is alternate embodiment of the invention using the same reference numbers where the facets are identical. In fact the only distinction between the embodiment of FIGS. 1A, 1B and 1C and the alternate embodiment of FIGS. 5A, 5B and 5C, respectively, is the omission of the eight small subsidiary pavilion cut corner facets ($a_2$) and the four facets (cc) on the cut corner pavilion sides shown in FIGS. 1A and 1C respectively. These facets do not contribute to the creation of the hearts and arrows pattern.

The crown portion 12 includes a flat table facet (TF) which is the uppermost and largest surface of the cut diamond, four main crown facets, symmetrically arranged around the flat table facet (TF) and four subsidiary crown facets (d) which are symmetrically arranged at each corner of the diamond 10 between the main crown facets (c) and represent the four corner facets of the diamond. Each of the four main crown facets (c) are cut on the side of the flat table facet (TF) to form two crown stars ($c_3$) and on the opposite side thereof to form two crown halves ($c_1$). Each subsidiary crown facet (d) of the princess cut of the present invention includes two subsidiary crown halves ($c_2$) with the subsidiary crown halves ($c_2$) being aligned in common at one end to form the cut corner sides of the diamond. Each of the subsidiary crown halves ($c_2$) on the cut corner side form an included angle of 45° with an abutting one of the crown halves ($c_i$). The parameters and polishing requirements to form a princess cut in accordance with the present invention will be discussed in greater detail hereafter.

The two crown stars ($c_3$) formed from each main crown facet (c) on the side abutting the table facet (TF) are in alignment meeting at a point essentially equal to half the distance of the adjoining main crown facet (c) measured longitudinally. The two crown halves ($c_i$) form a square edge on the side of the main crown opposite the table facet (TF). The eight (8) main crown halves ($c_i$), the eight (8) subsidiary crown halves ($c_2$) and the eight (8) facet crown stars ($c_3$) all have the shape of a triangle. The outer perimeter of the diamond 10 thus has eight sides inclusive of the four main crown sides formed by the eight (8) main facet crown halves ($c_i$) and the four cut corner sides (d) formed by the eight (8) subsidiary crown halves ($c_2$).

The girdle (g) which separates the crown portion 12 and the pavilion portion 14 has four main girdle facets which lie in a plane perpendicular to the plane of the flat table facet (TF) and may have four subsidiary cut corner facets. The height of the crown portion 12 is measured vertically from the flat table facet (TF) to the girdle (g). The pavilion portion 14 extends from the girdle (g) to a point 16, known as the culet, representing a distance commonly referred to as the pavilion depth. The pavilion portion 14 of the diamond 10 is illustrated in the bottom view FIG. 1C and in FIG. 5C for the alternate embodiment and consists of eight main pavilion facets (a) which terminate at the culet 16, sixteen (16) pavilion facet halves (a1) and four (4) subsidiary pavilion facets (b). In the embodiment of FIG. 1C eight (8) subsidiary pavilion cut corner side facets (a2) exist and four (4) facets (cc) referred to as girdle facets which, as is more clearly shown in FIGS. 1A and 1C, lie adjacent to the girdle (g). In the alternate embodiment as shown in FIGS. 5A, B and C the eight (8) subsidiary pavilion cut corner side facets (a2) and the four facets (cc) are omitted.

Figure 2A:
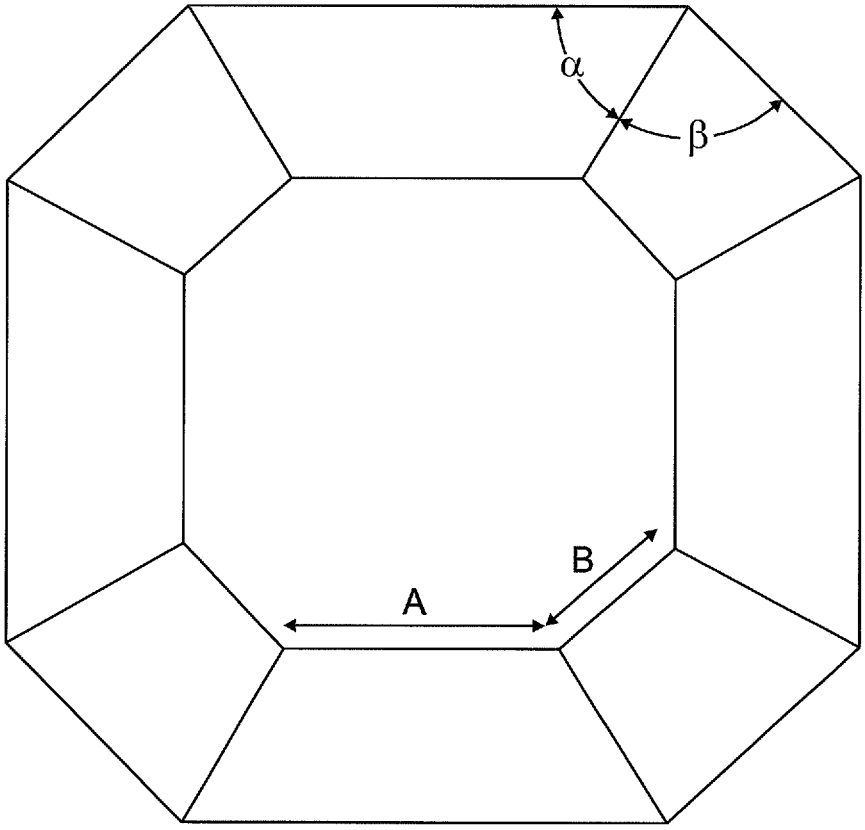
FIG. 2A is a top view of the princess cut of the present invention at an early first preliminary stage of development in accordance with the present invention.
Figure 2B:
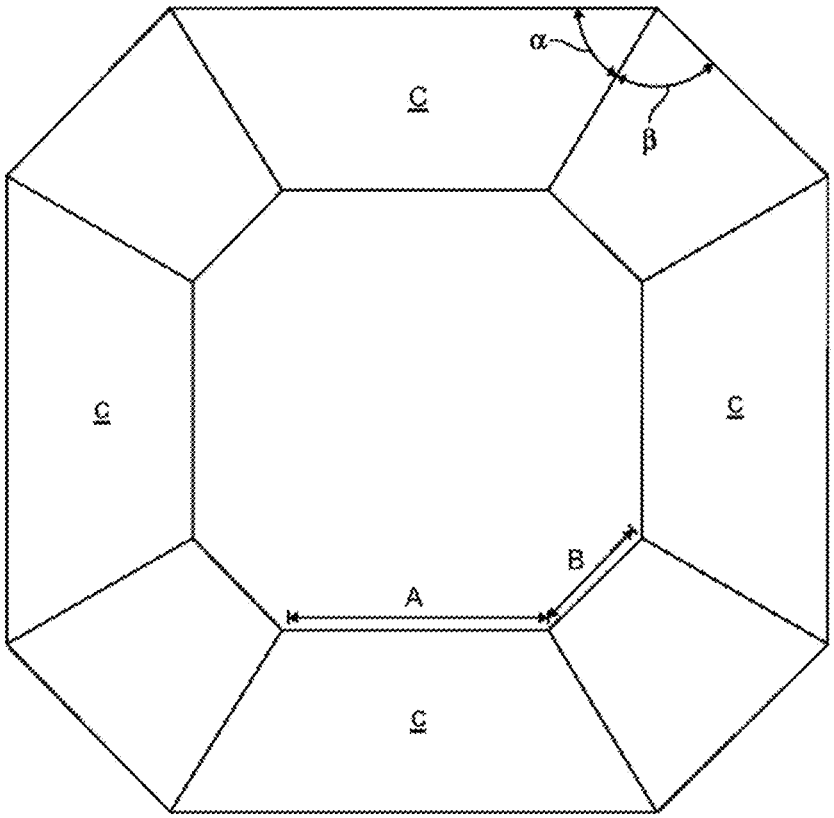
FIG. 2B is another top view of the princess cut similar to FIG. 1A at a final development stage in accordance with the present invention.
Figure 2C:
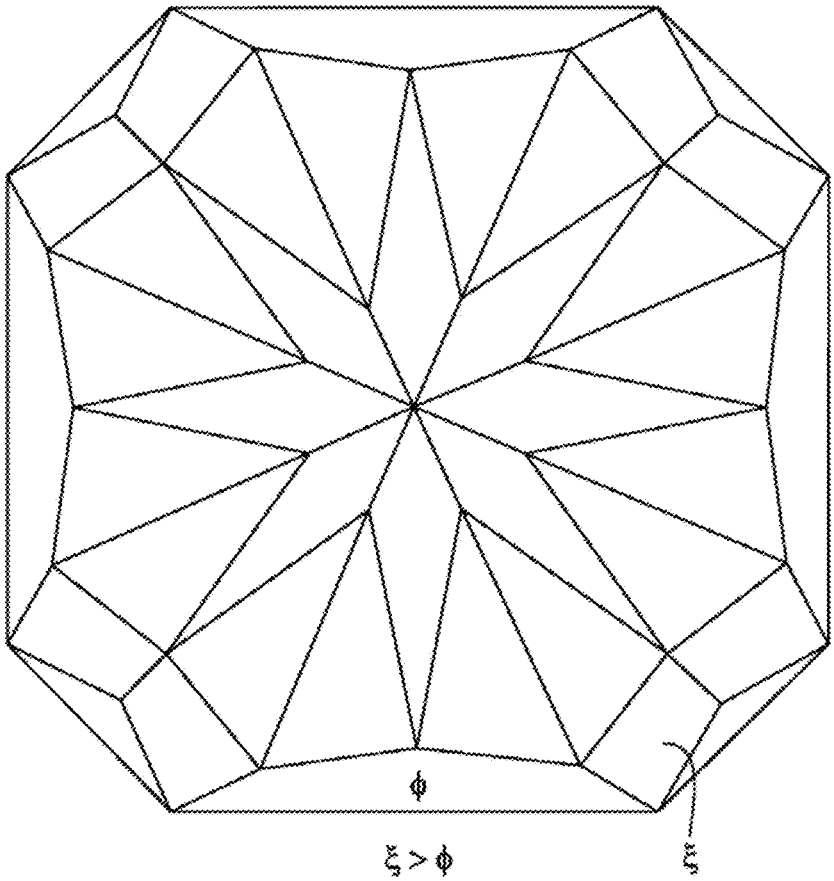
FIG. 2C is another bottom view of the princess cut similar to FIG. 1A at a final development stage in accordance with the present invention.

It is apparent from FIGS. 2A-2C that the eight sides of the princess cut diamond 10 are not of equal length. As is shown in FIG. 2A the square side A is longer than the cut corner side B with the main angles $\alpha$ polished so that $a>\beta$ with the cut corner main angle flatter than the main angle on the square side by 0.8°-1.2°. This difference in size between the main facets (c) on the square sides and on the cut corner sides enables the development of the hearts and arrows pattern in a princess cut as will be further explained hereafter.

In FIG. 1B, the crown star facets ($c_3$) are shown present only on the square sides of the diamond with each of the crown halves ($c_1$) on the square sides being longer than the subsidiary crown halves ($c_2$) on the cut corner sides. The main crown facets (c) and the corner crown facets (d) are polished to give the princess cut of the present invention a square appearance with the main crown and pavilion facets cut at very precise angles.

Figure 3A:
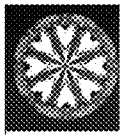
FIG. 3A and FIG. 3B show a true hearts and arrows pattern in an ideal round cut diamond.
Figure 3B:
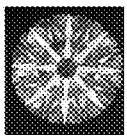
Figure 3C:
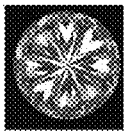
FIGS. 3C and 3D show examples of unacceptable hearts and arrows patterns adjacent to perfect hearts and arrows patterns.
Figure 3D:
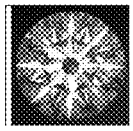

To a gemologist, cut is the most important factor affecting the beauty of a diamond. The round shaped diamond can be cut into a near perfect round shape with symmetrical facets causing a hearts and arrows pattern to appear. The hearts and arrows pattern can be readily viewed from the pavilion end of the diamond when light is illuminated on the table facet side. A true hearts and arrows pattern is considered the ultimate in cutting precision and is illustrated for the round cut in FIGS. 3A and 3B. As is evident from FIGS. 3A and 3B, an eight-fold-symmetry about an axis passing through the center of the table and the culet 16 exists with eight hearts and eight arrows with FIG. 3A showing 8 symmetrical hearts and FIG. 3B showing 8 symmetrical arrows. The "hearts" are clearly visible along the axis of symmetry of the diamond from the pavilion end with light illuminated at the table end and the "arrows pattern" is visible from the diamond at the table end when light is illuminated at the pavilion end. FIGS. 3C and 3D show examples of unacceptable hearts and arrows patterns adjacent a perfect hearts and arrows pattern.

The hearts and arrows pattern will result on a cut round diamond only when the following requirements are met:

- The shape of the diamond is symmetrical.
- 8 main crown and 24 subsidiary crown facets.
- 8 main bottom and 16 subsidiary bottom facets.
- All main facets (crown & bottom) have to be polished at a perfect 45° angle to each other.
- All facets are perfectly aligned.
- All the bottom main facets are of equal size and at an angle ranging from 40.6°-41.0°.

All the bottom subsidiary facets are of equal size and at an angle which exactly 1.20 steeper than the main facets (main bottom angle 40.6°-41.0°+subsidiary 41 8°-42.2°.

All the main crown facets are of equal size and at an angle ranging from 33.8°-35.1° and are perfectly aligned on the main bottom facets.

All the subsidiary crown facets are of equal size and perfectly aligned on the main crown and subsidiary bottom facets and polished at an equal angle.

The cut proportions should be as follows:

total depth 59.4%-62.4%
crown height 14.5%-1 6.0%
girdle thickness 1.5%-2.95%
Roundness 99.0%-100%
Table size: 53.0%-57.5%

Total depth in %=height/width×100 where height is measured from the table facet (TF) to the culet and where width is the diameter of the girdle Angle discrepancy between main facets are smaller than 1° and less than 0.5° between subsidiary facets It is extremely difficult to generate a hearts and arrows pattern in a princess cut due to the fact that the square shape of the princess cut is less symmetrical than the round cut, the number of facets are different and light reflects differently. Moreover, for a princess cut it is necessary to have a minimum of eight main crowns, represented by the combination of main and subsidiary crown facets and that each main crown should have a parallel main opposite crown. The difficulties in forming a true hearts and arrows pattern for a princess cut have been resolved in accordance with the present invention by polishing the cut corner sides (d) smaller than the four main sides as explained above in connection with FIG. 28 so that an octagonal geometry having equal sides is prevented when viewing the diamond 10 from the table side and to allow the polishing of all of the subsidiary crown halves facets ($c_2$) on each of the cut corner sides at an angle of exactly 45 degree; i.e., the included angle existing between the subsidiary crown halves facets ($c_2$) on the cut corner sides and the crown halve main facets ($c_1$) on the square sides should be exactly 45°. In addition the eight star facets ($c_3$) which abut the table are polished while leaving the four subsidiary crown facets (d) on the cut corner sides untouched. In addition, as explained above in connection with FIG. 2C the subsidiary pavilion facets on the cut corner side are polished at a steeper (greater) angle than on the longer subsidiary pavilion square sides so that $\xi>\phi$.

The following additional parameter requirements should be met to obtain a true hearts and arrows pattern in the princess cut:

Total Depth 68%-71% measured similarly to the round cut with the width measurement being the girdle dimension longitudinally Pavilion Depth 51%-53.5%
Crown Height 14%-1 5.5%
Table Size 53%-59%
Girdle Thickness 1%-3.5%

The Hearts & Arrows pattern will appear without distortion if the cut parameters fall between the above ranges and the main crown and pavilion facets are cut to the following very precise angles:

Main Pavilion angles 40.6°-41.0°
Main Crown angles 34.0°-35.2°
Subsidiary Pavilion angles 64°-67°
Subsidiary crown angles 33.5°-34.5°.

The angles of the Pavilion Halves are 1.2° steeper than the main pavilion angle.

Crown Halves have angles that are 3.8°-4.2° steeper than the main crown angles.

Crown Star angles are 4°-5° flatter than main crown angles.

Furthermore, it is essential for all the facets be cut to a very small angle tolerance, i.e. the angle difference between all pavilion angles has to be smaller than 0.3° and the angle tolerance between the four main crown facets must be smaller than 0.4° and 0.3° for the four subsidiary crown facets.

When all of the above is accomplished the manufacturing of the Princess Hearts & Arrows diamond will have a near perfect symmetry provided that the polishing meets the following additional requirements:

All polished crown and pavilion facets be of equal size, a tolerance of 0.04% is allowed between the various facets;

The Culet (point of the diamond) has to be perfectly centered with a tolerance of 0.03%;

The shape of the diamond, as determined from the girdle; i.e., the four main girdle facets and the four subsidiary girdle facets (the ones in the corners) should be such that they are polished to be at a 45 degree angle relative to one another with a tolerance of 0.030 allowed; and The four main girdle facets have to be identical in length so that when measured the result shows a length/width ratio of 1.00; a tolerance of 0.035 is allowed.

When all of the above mentioned cut parameters are observed the stone is ready to undergo the final polishing process steps which will give the stone its brilliance and allow for the Hearts & arrows pattern to appear:

Pavilion halves must be polished to near perfect symmetry and depth and be perfectly aligned with each other;

Crown Halves must be polished to near perfect symmetry and depth and be perfectly aligned with each other and perfectly aligned with the Pavilion Halves; and Crown Stars must be polished to near perfect symmetry and must join each other at exactly half the distance of the main crown facet.

All stars and halves are to be polished with identical angles, a maximum tolerance of 0.30 is allowed.

Figure 4A:
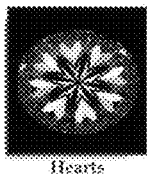
FIGS. 4A and 4B shows the hearts and arrow pattern, respectively, for the princess cut diamond according to the present invention
Figure 4B:
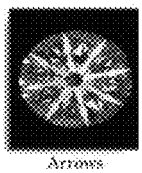

When all of the facets of the princess diamond are cut following the above procedure a hearts and arrows pattern will be achieved having the hearts and arrows characteristic of an ideal round cut diamond. Moreover, the modified princess cut diamond of the present invention not only possesses a hearts and arrows pattern but exhibits a straight edge square shape. FIGS. 4A and 4B show the hearts and arrow pattern of the modified princess diamond cut according to the present invention.

What is claimed is:

1. A modified princess cut diamond having a symmetrical shape possessing a hearts and arrows pattern characteristic of the true hearts and arrows pattern in a round cut diamond comprising: a tablet facet, 4 main crown facets, 8 crown halves, 8 crown star facets, 4 subsidiary crown facets, 8 subsidiary crown halves, 8 main pavilion facets, 4 subsidiary pavilion facets, 16 pavilion facet halves and a girdle with each main crown facet having a pair of crown star facets symmetrically disposed on one side thereof adjacent to the table facet, and a pair of main crown halves symmetrically disposed on the opposite side thereof, with each pair of crown star facets having a side thereof adjoining the table facet meeting at a point equal to essentially half the longer distance of the main crown facet measured horizontally, and with all crown star facets having identical polished angles and with the subsidiary crown halves adjacent each main crown facet having identical polished angles measured from the surface of the table facet to a maximum tolerance of 0.3°, with each of the crown halves polished into alignment with each other and into alignment with the pavilion facet halves, and that the subsidiary crown halves are aligned in common at each end of the diamond to form a cut corner in the diamond at each such end thereof, with each of the subsidiary crown halves at each end of the diamond, having a polished angle smaller than the main crown halves for forming an included angle of 45° with an abutting one of the adjacent main crown-halves, and wherein the angle of the pavilion halves is steeper than the main pavilion angle, wherein the main crown and pavilion facets having the following cut angles:

main pavilion angles 40.6°-41.0° main crown angles 34.0°-35.2°; and subsidiary crown facet angles are between 33.5°-34.5°.

2. A princess cut diamond as defined in claim 1 wherein (1) the pavilion half angles are 1.2° larger than the main pavilion angles; (2) the crown halves are 3.8° larger than the main crown angles; and (3) the crown star angles are 4°-5° flatter than the main crown angles.

3. A method for polishing a diamond to form a modified princess cut diamond which will display a hearts and arrows pattern comprising: a tablet facet, 4 main crown facets, 8 crown halves, 8 crown star facets, 4 subsidiary crown facets, 8 subsidiary crown halves, 8 main pavilion facets, 4 subsidiary pavilion facets, 16 pavilion halves, and a girdle having a substantially uniform thickness on all sides of the diamond with each main crown facet having a pair of crown star facets symmetrically disposed on one side thereof adjacent to the table facet, and a pair of main crown halves symmetrically disposed on the opposite side thereof, wherein the princess cut possesses a hearts and arrows pattern characteristic of the true hearts and arrows pattern in a round cut diamond, said method comprising the steps of: polishing the subsidiary crown facets to be smaller in length than the length of the crown halves, polishing the subsidiary crown halves to lie at exactly a 45° angle relative to the adjacent crown half, polishing each of the crown halves into alignment with each other and into alignment with the pavilion half facets, and with the crown halves forming an included angle a which is larger than the adjacent included angle β formed by the subsidiary crown facets on the cut corner sides of the diamond, so as to allow-the crown halves to be of equal size and the subsidiary crown halves to be of equal size, and wherein the angle of the pavilion halves is steeper than the main pavilion angle, the crown halves are at an angle steeper than the angle of the main crown angles and the total depth of the princess cut is between 68%-71% wherein total depth in % =height/width×100 wherein the hearts and arrows pattern generated by the modified princess cut diamond forms 8 perfectly symmetrical arrows and 8 perfectly symmetrical hearts which can be visually observed using a conventional scope in the presence of light.

4. A method as defined in claim 3 wherein the main crown and pavilion facets having the following cut angles:

main pavilion facet angles are between 40.6°-41°;

main crown facet angles are between 34.0°-35.2°; and subsidiary crown facet angles are between 33.5°-34.5°.

5. A method as defined in claim 4 wherein (1) the angles of the pavilion halve facets measured from the table facet (TF) are 1.2° larger than the angles formed by the main pavilion facets; (2) the angles formed by the crown halve facets are polished from the table facet (TF) and are 3.8° larger in size than the angles ($c_2$) formed by the main crown facets (c) and (3) the angles of the crown star facets are polished from the table facet (TF) so that angle formed by a crown star facet is 4°-5° flatter than the corresponding angle formed by the main crown facet.

6. A method as defined in claim 5 wherein all facets are cut from the table facet surface (TF) with a small angle tolerance such that the cut angle difference between all pavilion angles are smaller than 0.3° and the angle tolerance between the four main crown facets are smaller than 0.4° and the angle tolerance between the four subsidiary crown facets are smaller than 0.3°.

7. A method as defined in claim 4 wherein all facets are cut with a small angle tolerance such that the angle difference between all pavilion angles are smaller than 0.3° and the angle tolerance between the four main crown facets are smaller than 0.4° and the angle tolerance between the four subsidiary crown facets are smaller than 0.3°.

* * * * *